United States Patent [19]

Hatada et al.

[11] 4,300,629

[45] Nov. 17, 1981

[54] CROSS-FIN TUBE TYPE HEAT EXCHANGER

[75] Inventors: Toshio Hatada; Takao Senshu; Akira Arai; Fumio Harada, all of Shimizu; Atsushi Matsuzaki, Tokyo; Hajime Futawatari, Shimizu; Yutaka Imaizumi, Yaizu; Sumiyoshi Takeda, Shimizu, all of Japan

[73] Assignee: Hitachi, Ltd., Tokyo, Japan

[21] Appl. No.: 50,455

[22] Filed: Jun. 20, 1979

[30] Foreign Application Priority Data

Jun. 21, 1978 [JP] Japan ..... 53-74187

[51] Int. Cl.[3] ..... F28F 1/32; F28F 1/38

[52] U.S. Cl. ..... 165/151

[58] Field of Search ..... 165/151, 152, 153

[56] References Cited

U.S. PATENT DOCUMENTS

| | | | |
|---|---|---|---|
| 2,079,032 | 5/1937 | Opitz | 165/151 |
| 2,703,226 | 3/1955 | Simpelaar | 165/153 |
| 2,789,797 | 4/1957 | Simpelaar | 165/170 |
| 3,003,749 | 10/1961 | Morse | 165/152 |
| 3,135,320 | 6/1964 | Forgo | 165/181 |
| 3,298,432 | 1/1967 | Przyborowski | 165/153 |
| 3,380,518 | 4/1968 | Canteloube et al. | 165/171 |
| 3,397,741 | 8/1968 | Gunter | 165/152 |
| 3,438,433 | 4/1969 | Gunter | 165/151 |
| 3,796,258 | 3/1974 | Malhotra et al. | 165/151 |

FOREIGN PATENT DOCUMENTS

| | | | |
|---|---|---|---|
| 1212901 | 3/1960 | France | 165/151 |
| 53-17867 | 7/1978 | Japan | 165/151 |
| 2023798 | 1/1980 | United Kingdom | 165/151 |

*Primary Examiner*—Sheldon J. Richter
*Attorney, Agent, or Firm*—Craig and Antonelli

[57] ABSTRACT

A cross-fin tube type heat exchanger having a large number of parallel fins and a plurality of heat transfer tubes extended through and fixed to the fins, so that heat may be exchanged between a first heat exchanging medium flowing through the heat transfer tubes and a second heat exchanging medium flowing along the surfaces of the fin, across the walls of the heat transfer tubes and through the fins. In the portions of each fin between adjacent heat transfer tubes of the same row, formed are a number of slits perpendicular to the direction of flow of the second heat exchanging medium. Each elongated section defined between each pair of adjacent slits is bent along its breadthwise bisector line and is raised in the form of a bridge to constitute an upwardly convexed louver element. The upwardly convexed louver element may have a cross section with an obtuse apex angle, or may have an arcuate cross section. The successive louver elements are arrayed in the direction of flow of the second heat exchanging medium in a manner of corrugation, or alternately staggered in the heightwise direction so that the edges of adjacent louver elements may be staggered in the heightwise direction. The fins having louver elements thus constructed cause a turbulency of the flow of the second heat exchanging medium to effectively prevent boundary layers of the latter from growing, thereby to ensure a higher efficiency of the heat exchange. Also increased stiffness or rigidity of the fin is obtained thanks to the provision of upwardly convexed louver elements.

25 Claims, 14 Drawing Figures

CROSS-FIN TUBE TYPE HEAT EXCHANGER

BACKGROUND OF THE INVENTION

The present invention relates to a heat exchanger adapted for a heat exchange between air and a heat carrying medium, for use in air-conditioning system, refrigerating system, dehumidifier and the like and, more particularly, to a cross-fin tube type heat exchanger having a multiplicity of fins provided with a large number of louvers formed therein.

A typical conventional cross-fin tube type heat exchanger has a multiplicity of fins made of aluminum sheets of a predetermined area and having a plurality of bores for receiving heat transfer tubes. These fins are disposed in parallel with one another such that the bores of these fins are axially aligned with corresponding bores of the other fins. A plurality of heat transfer tubes are inserted into respective bores of the fins, and are closely fitted and fixed to the latter by means of tube expansion or the like measure. The ends of the tubes projecting out of the outermost fins are connected by means of U-bent tubes so as to form a suitable number of continuous winding heat transfer tube passages.

A heat exchanging fluid or medium such as cold water, hot water, refrigerant or the like is made to flow in thus formed heat transfer tubes, while another heat exchanging fluid or medium, typically air, is made to flow through the gaps between adjacent fins at a suitable flow velocity, whereby heat is exchanged between two fluids or mediums across the tube wall and fins.

The cross-fin tube type heat exchanger having above-stated construction in one hand enjoys advantages of comparatively large area of heat transfer and reduced size, but, on the other hand, possesses the following problems.

In the heat exchange between two mediums flowing inside and outside of the tubes, boundary layers of the medium flowing outside the tubes, e.g. air, are formed along the surfaces of the fins and seriously deteriorates the heat transfer. These boundary layers, i.e. boundary layer of velocity and the boundary layer of temperature develop as the air flows from the upstream side end of the fins toward the downstream side end, and the velocity and temperature boundary layers on adjacent two fins merge in each other at a point slightly downstream from the upstream ends of these fins to largely decrease the heat transfer rate.

Therefore, in the cross-fin tube type heat exchanger having planar or tubular fins, the rate of heat transfer is inevitably lowered due to the presence of the velocity and temperature boundary layers.

It is, therefore, an effective measure for improving the rate of heat transfer, to prevent the boundary layers from developing or growing.

From this point of view, there have been proposed various improvements in the construction of fin surfaces.

For instance, the specifications of U.S. Pat. Nos. 3,380,518, 3,397,741 and 3,438,433 propose a heat exchanger having a multiplicity of planar fins in which a large number of tabular louver elements are formed in the direction perpendicular to the direction of flow of the air flowing through the gaps between adjacent fins. As the air flows into these gaps, the velocity and temperature boundary layers are formed along the fin surfaces. However, the development of these boundary layers are suppressed at the rear end of each louver element, and are thinned considerably by the action of main flow of air before they reach the next louver element. As a result of such a pattern of air flow, a considerably large effect of cutting the air flow by the leading edges of the louvers, which effect is usually referred to as "leading edge effect of louver", is brought about to improve the efficiency of heat transfer over conventional tabular fins having smooth surfaces. In this heat exchanger, however, each louver element itself has a tabular or flat form.

Japanese Utility Model Application Laid-open No. 17867/1978 discloses a heat exchanger in which each fin is constituted by a corrugated fin plate with ridges extending perpendicular to the direction of flow of the air, and a large number of louver elements which are raised in parallel with one another from the corrugated fin plate.

This type of heat exchanger aims at improving the heat transfer efficiency by a combination effect of promoting turbulency by the corrugation of the fin plate and the aforementioned cutting of air flow by the leading edges of the louvers. In this heat exchanger, however, the louver elements themselves have tabular or flat shape as in the case of heat exchangers proposed by aforementioned United States Patents.

Meanwhile, the specification of U.S. Pat. No. 3,796,258 discloses a heat exchanger in which, as in the case of the above-mentioned Japanese Utility Model Application, each fin is constituted by a corrugated fin plate.

In this case, however, apertures are formed in each fin, instead of the louver elements.

This heat exchanger also improves the heat transfer efficiency by causing turbulent flow of the air, through destroying the boundary layers formed on the surfaces of fins. In this heat exchanger, however, there are no louvers formed in the fins.

The prior art heretofore described more or less achieves the improvement of heat transfer efficiency of the heat exchanger of cross-fin tube type.

Nevertheless, there still is a demand for further improving the heat transfer efficiency of heat exchangers of the kind described.

Apart from the above, the heat exchangers having tabular fins with louvers have a common disadvantage that the rigidity of the fins, particularly in the longitudinal direction of the louvers, is decreased because of a large number of slits which are formed in the fin plate for the formation of the louver elements. This reduction of rigidity is quite disadvantageous and vital from the viewpoint of thinning of fins and facilitation of the assembling work.

Thus, there also is an increasing demand for increase of rigidity of fins of heat exchangers of the kind described.

SUMMARY OF THE INVENTION

It is, therefore, an object of the invention to further improve the efficiency of heat transfer between a heat carrying medium flowing through the heat transfer tubes and air flowing through gaps between adjacent ones of a large number of parallel fins, in a cross-fin tube type heat exchanger.

It is another object of the invention to increase the rigidity of fins of cross-fin tube type heat exchanger having a large number of louver elements and, as a result of the increased rigidity, to further thin the fins, as well as to facilitate the assembling of the heat exchanger.

It is still another object of the invention to provide an advantageous and preferred shape of the louver elements formed in the fins of a cross-fin tube type heat exchanger.

It is still another object of the invention to provide an advantageous and preferred shape of the louver elements formed in the fins of a cross-fin tube type heat exchanger.

To this end, according to the invention, there is provided a heat exchanger of cross-fin tube type having the following structural features.

Each fin sheet of the heat exchanger has a large number of parallel slits formed at portions thereof between adjacent tube-receiving bores of the same row of tube. The slits extend at a right angle to the direction of flow of the air passing through the gap between adjacent fins. The narrowed slitted areas formed between adjacent slits are then bent along their breadthwise bisectors to have upwardly convexed cross-section and are then raised above the plane of the fin member in a bridge-like manner to form a plurality of upwardly convexed louvers elements. The louver elements have different heights from the plane of the fin plate such that edges of adjacent louver elements are staggered in the direction of their heights. A large number of fins thus formed are then laid in parallel with one another such that their tube-receiving bores are axially aligned. Then, after insertion into the tube-receiving bores, the heat transfer tubes are fixed to the fin plates to complete the heat exchanger.

The heat exchanging medium such as air flowing into the heat exchangers is suitably distributed to all gaps between pairs of adjacent fins to flow through these gaps. The flow of the medium is then cut as it collides with each upwardly directed louver element, so that the undesirable velocity and temperature boundary layers of the fluid flowing along the fin surface are destroyed and cut before they grow. The velocity and temperature boundary layers tend to grow also along the surfaces of the upwardly convexed louver elements. However, the stratification of the heat exchanging medium is largely suppressed at the portion of each louver element downstream from the crest. In consequence, the flow of the heat exchanging medium through the gap between adjacent fins is disturbed and the pattern of flow is rendered highly complicated to permit a vigorous heat exchange between two heat exchanging mediums flowing through the tubes and through the gaps between fins, thereby to greatly improve the efficiency of the heat exchange.

In addition, the stiffness or rigidity of the fins in the longitudinal direction of louvers (direction in which the tubes are arrayed) is remarkably increased, because a large number of upwardly convexed louver elements formed in the portions of fin plate between adjacent tube-receiving bores are bent along the breadthwise bisectors, i.e. in the direction perpendicular to the direction in which the tubes are arrayed.

Due to this feature, it becomes possible to support more easily a large number of fins at a predetermined constant pitch, even when these fins have a large length, so that various assembling works such as insertion of the tubes, fixation by expanding of the tubes and so forth are much facilitated and the efficiency of the production is remarkably improved.

The increment of the stiffness or rigidity of the fin also permits the use of fins having reduced thickness to lower the material cost.

According to preferred forms of the invention, each upwardly convexed louver element is formed to have an obtuse apex angle with the edge line extending on the breadthwise bisector line of the elongated section formed between adjacent slits, or to have an arcuate cross-section with its ridge extending on the breadthwise bisector line of the elongated section.

In addition, a plurality of groups of louvers, each of which includes a plurality of upwardly convexed louver elements, of each fin are disposed in the form of a continuous wave or corrugation in the direction in which the fin extends. Alternatively, the successive louver elements are staggered in the direction of their heights, such that the successive louver elements take the high and low positions alternately.

The fin having the groups of louvers arranged in a corrugated manner may be produced by forming the upwardly convexed louver elements in the corrugated fin plate.

As to the shape of the upwardly convexed louver elements, the angle of the side wall or flank of the louver to the direction in which the fin extends, i.e. to the plane of the fin, preferably falls within the range of between 8° and 24°.

In the heat exchanger of the invention, the heat exchange is promoted by a combination of the leading edge effect, i.e. the cutting of stream line of air by the leading edges of the louvers, and the effect provided by the upwardly convexed form of the louvers which enhances the turbulency of flow of air. The enhancement of the turbulency of the air flow on the other hand incurs increase of the pressure loss of the fluid flowing along the fins, although it on one hand contributes to the improvement in the heat transfer efficiency.

Although the heat transfer efficiency is increased as the angle of inclination of the flank of the upwardly convexed louver element is increased, such an increment is inevitably accompanied by the increase of the pressure loss which in turn causes an increment of level of noise. The increment of the pressure loss becomes drastic as the angle of inclination of the upwardly convexed louver element exceeds 24°. For this reason, the angle of inclination of the flank of the upwardly convexed louver element in excess of 24° is not recommended.

Referring now to the stiffness or rigidity, the second moment of area which relates to the rigidity of the fin having upwardly convexed louver elements is materially identical to that of a fin having no louvers, if the angle of inclination of the flank of louver element is not greater than 8°. As the angle of inclination exceeds 8°, the second moment of area is increased in accordance with the increment of the inclination angle. For this reason, the inclination angle exceeding 8° is preferred.

When the upwardly convexed louver element has an arcuate cross-section, the angle of inclination of the flank of the louver element is given on an assumption that the arcuate cross-section approximates the cross-section having an obtuse apex angle. Namely, in this case, the angle of inclination of the louver flank is given as the angle formed between the direction in which the fin extends and the line tangent to the mid point of the flank, i.e. to the mid point between the vertex and the lower edge of each flank.

These and other objects, as well as advantageous features of the invention will become more clear from the following description of the preferred embodiments taken in conjunction with the accompanying drawings.

DESCRIPTION OF THE PREFERRED EMBODIMENTS

Figure 1:
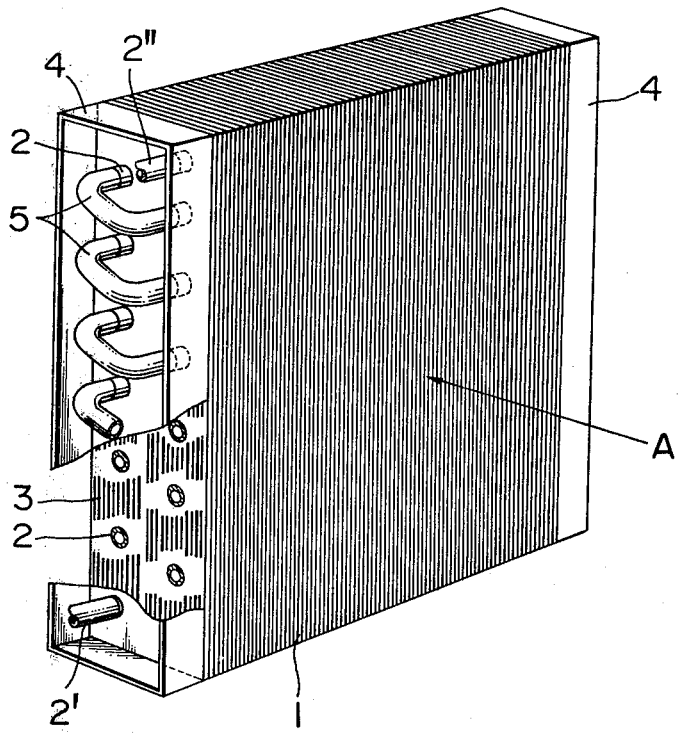
FIG. 1 is a perspective view of a heat exchanger which is an embodiment of the invention.

Referring first to FIG. 1, a heat exchanger embodying the present invention has a plurality of fins 1 made of, for example, aluminum sheets. These fins 1 are provided with a plurality of bores for receiving heat transfer tubes 2. A large number of upwardly convexed louver elements 3 are formed on the portions of each fin 1 between pairs of adjacent tube-receiving bores. A large number of fins 1 are disposed side by side at a constant pitch of several millimeters. Side plates 4,4 are attached to the outermost fins. A plurality of heat transfer tubes 2 are received by the tube-receiving bores of the fins 1 and are closely fitted and fixed to the latter by a tube expansion or the like measure. The ends of the heat transfer tubes extending out of the outermost fins are suitably connected by means of U-shaped tubes 5 so as to provide hair-pinlike connections thereby to complete a continuous winding passage having an inlet 2' and an outlet 2''.

A heat exchanging medium such as a refrigerant, cold water, hot water or the like flows into the heat transfer tube 2 through the inlet 2' and comes out of the tube through the outlet 2''.

Meanwhile, another heat exchanging medium, typically air, is made to flow through the gaps formed between adjacent fins at a suitable velocity in the direction of arrow A, so that the heat is exchanged between the two mediums across the tube wall and through the fin.

Hereinafter, a description will be made as to how the fin 1 having the upwardly convexed louver elements is constructed.

Figure 2:
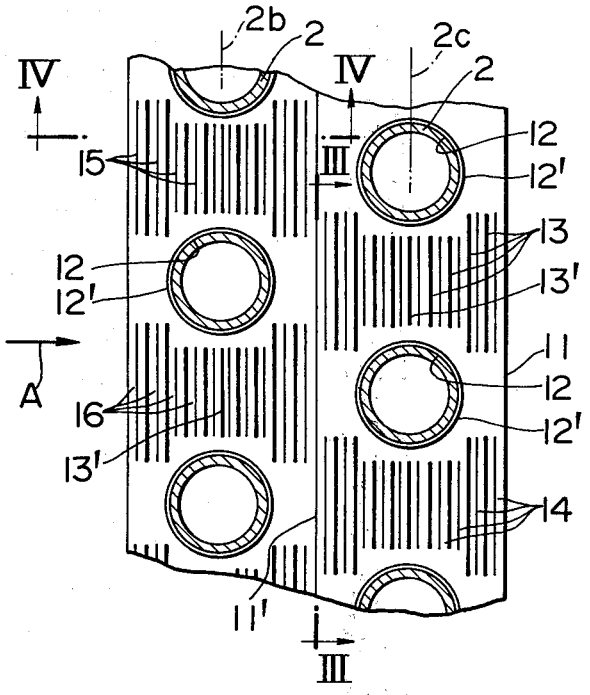
FIG. 2 is a plan view of a portion of a fin incorporated in the heat exchanger shown in FIG. 1, including two rows of heat transfer tubes and having upwardly concave louver elements each having an obtuse apex angle.
Figure 3:
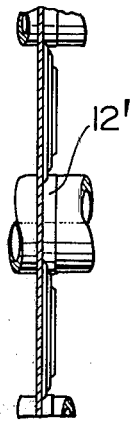
FIG. 3 is a sectional view of the fin as a sole body, taken along the line III—III of FIG. 2.
Figure 4:
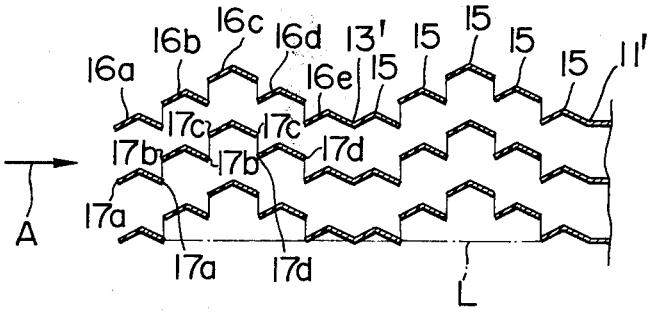
FIG. 4 is an enlarged sectional view taken along the line IV—IV of FIG. 2.

FIGS. 2, 3 and 4 show a fin in which two rows **2*b* and 2*c* of the heat transfer tube 2 are disposed in a staggered or zigzag manner. More specifically, the fin has a tabular fin plate 11 in which formed are a plurality of tube-receiving bores 12 disposed in a zigzag manner. A collar 12' is formed on the brim of each bore 12**.

As will be most clearly seen from FIG. 2, in the portion of the fin plate 11 between adjacent tube-receiving bores 12 spaced in the direction of the rows **2*b* and 2*c* of the tubes, formed are a large number of parallel slits 13 which extend in the direction substantially perpendicular to the direction A of flow of the heat exchanger medium flowing along the fins, i.e. substantially in the direction of rows of the tubes. The lines denoted by numerals 13' and 11' in FIG. 2 are not slitted. A plurality of elongated sections 14 are formed between pairs of adjacent slits 13. Each elongated section 14 is bent along its breadthwise bisector line 15 such that an obtuse apex angle is formed which diverges downwardly from the bisector line or edge line 15, as shown in FIG. 4. The elongated sections 14 are raised above the plane of the fin like bridges to form a plurality of upwardly convexed louver elements having the obtuse angle. The louver elements 16*a*,16*b*,16*c*,16*d* and 16*e* are made to have different heights so that the edges 17*a*, 17*b*,17*c***, . . . of adjacent louvers are staggered or offset in the direction of the heights of the louvers.

Thus, in each fin, formed are a plurality of groups of louver elements which are contiguous to each other. Each group includes a plurality of upwardly convexed louver elements **16*a*,16*b*,16*c*,16*d* and 16*e*** which are arranged at different heights in the form of a mountain as a whole. The successive groups of the louver elements therefore extend continuously in a way or corrugated line in the direction L.

Hereinunder, an explanation will be given as to how the cross-fin tube type heat exchanger having fins with above-described construction operates, with specific reference to FIG. 5.

As the heat exchanging medium flows into the heat exchanger as shown by arrow A, the flow of the medium is suitably distributed to all gaps between pairs of adjacent fins so that the streamlines of the heat exchanging medium are formed as shown by arrows a in each gap between adjacent fins. Since the fin has a plurality of upwardly convexed louver elements **16*a*,16*b*,16**i c, . . . which extend in the direction perpendicular to the direction A of flow of the heat exchanging medium, the streamlines and thermal boundary layers of the medium flowing along the fin surfaces are cut and destroyed before they grow or develop.

Furthermore, the streamlines and temperature boundary layers tend to grow and develop along the surfaces of the upwardly convexed louver elements 16a,16b,16c . . . However, stratification of the heat exchanging medium along the surfaces of each louver element is hindered by the generation of delaminating or turbulent flow portion 20 at the inside of the louver element and also at the space outside the louver element downstream of the edge line 15. Thus, the stream of the heat exchanging medium between adjacent fins is disturbed in a complicated manner to promote the extinction of the stream lines and thermal boundary layers which remain on the trailing edge of each louver element, and each louver element achieves its leading edge effect positively to remarkably improve the efficiency of heat transfer between the fins and the heat exchanging medium flowing along the latter.

In addition, the stiffness or rigidity of the fin in the direction of rows of tubes is increased, because the louver elements formed in the portions of the fin between adjacent tube-receiving bores in the same row of tube are convexed in the direction perpendicular to the direction of row or array of the tubes. This considerably contributes to the improvement in efficiency of assembling of the heat exchanger. Also, the increased stiffness or rigidity of the fin permits a reduction of thickness of the fin, which in turn lowers the material cost considerably.

As has been described, in the heat exchanger of the invention, a high heat exchanging efficiency is ensured by a combination of the leading edge effect of each louver element and the effect of promotion of turbulency provided by each upwardly convexed louver element.

It is to be noted that, the promotion of the turbulency of flow of the heat exchanging medium, which on one hand increases the heat transfer rate $\alpha$, on the other hand increases the pressure loss $\Delta P$ undesirably.

In the use of a heat exchanger, there is a practical limit in the capacity or power of a fan for forcibly supplying the heat exchanging medium to the heat exchanger and in the allowable level of noise produced during operation. In designing a heat exchanger, it is necessary to take these requisites into consideration.

Figure 5:
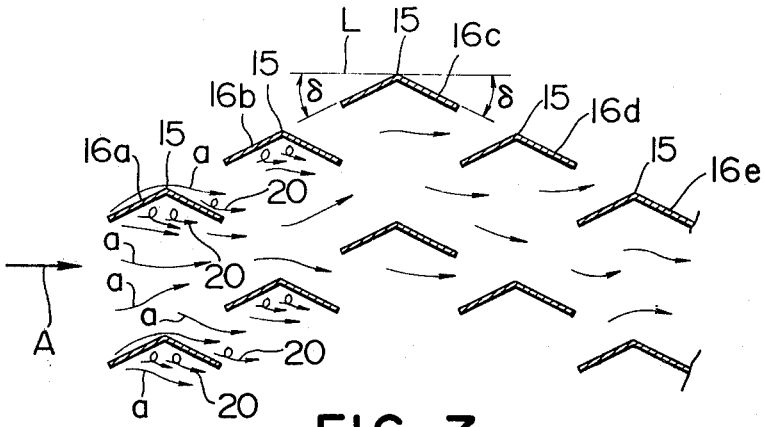
FIG. 5 shows an enlarged view of a part of the fin shown in FIG. 4, together with the pattern of flow of air.

In the heat exchanger of the invention, the factor which directly affects the heat transfer rate and the pressure loss is the angle $\delta$ of inclination of each flank of the upwardly convexed louver element shown in FIG. 5. It has been confirmed that both of the heat transfer rate $\alpha$ and the pressure loss $\Delta P$ are increased as the angle $\delta$ of inclination is increased. It is therefore possible to make suitable ratio $\alpha/\Delta P$, which is the ratio of the heat transfer rate $\alpha$ to the pressure loss $\Delta P$ by suitably selecting the angle $\Delta$ of inclination.

As shown in the drawings, the angle $\Delta$ of inclination of the flank of upwardly convexed louver element preferably falls within the scope of between 8° and 24°.

Figure 6:
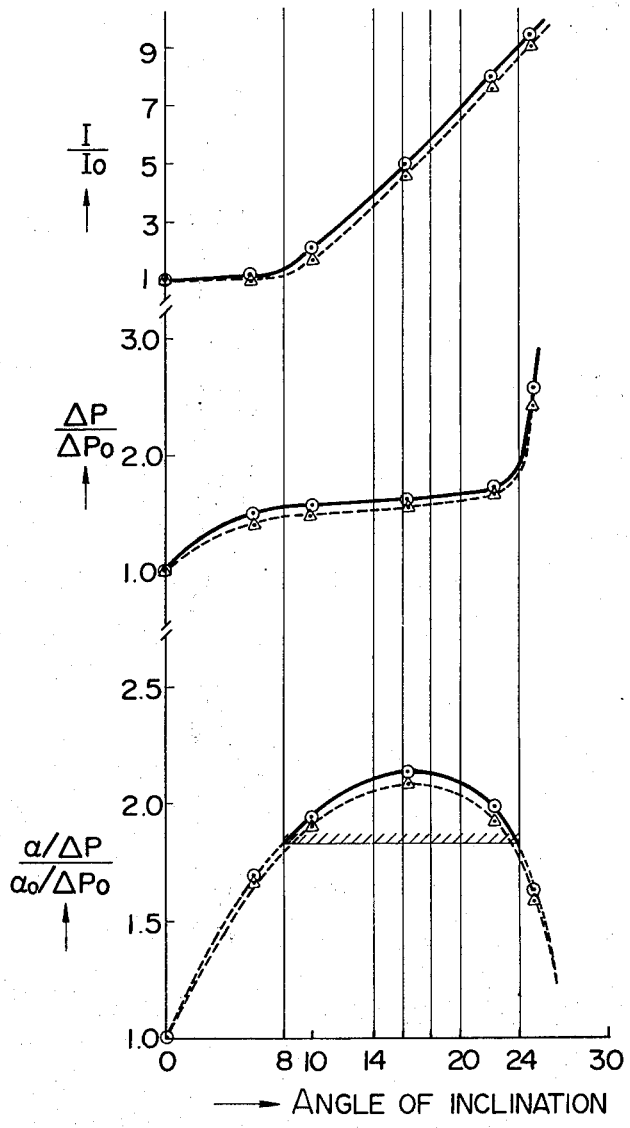
FIG. 6 is a diagram showing how the second moment of area, pressure loss and the efficiency of heat transfer are changed according to the change in the angle of inclination of flank of the upwardly convexed louver element to the direction in which the fin extends.

FIG. 6 shows how the ratio $\alpha/\Delta P$, the pressure loss $\Delta P$ and the second moment of area I of the fin which relates to the rigidity of the fin are changed according to the change in the inclination angle $\delta$, in the form of ratios to the values Io, $\Delta Po$ and $\alpha o/\Delta Po$ obtained when the angle $\delta$ is 0°, i.e. when the louver element has a flat surface parallel with the plane of the fin. The curves in FIG. 6 are drawn making use of data obtained through experiments.

From FIG. 6, it will be seen that the ratio $\alpha/\Delta P$ of the heat transfer rate $\alpha$ to the pressure loss $\Delta P$ is increased as the angle $\delta$ of inclination increases, and reaches the maximum level as the inclination angle $\delta$ is increased to about 16° or 17° and, thereafter, the ratio is gradually decreased.

On the other hand, the pressure loss $\Delta P$ which is directly related to the level of the noise is increased as the angle $\delta$ of inclination is increased. However, the gradient or slope of increase of the pressure loss $\Delta P$ is comparatively gentle while the angle $\delta$ of inclination is between 8° and 24°, and becomes steep as the angle $\delta$ is increased beyond 24°. For this reason, the inclination angle $\delta$ greater than 24° is not desirable.

As to the second moment of area I of the fin which directly relates to the stiffness or rigidity of the latter, the angle $\delta$ smaller than 8° can only provide a second moment of area which is nearly as low as that of a flat fin having no louver. However, the second moment of area is gradually increased as the inclination angle $\delta$ is increased beyond 8°.

Thus, the inclination angle within the scope of 8° to 24° ($8° \leqq \delta \leqq 24°$) as hatched in FIG. 6 can provide a specifically high value of the ratio $\alpha/\Delta P$, and well satisfies the object of the invention.

From the viewpoint of efficient use of the power for driving the fan, the angle $\delta$ of inclination preferably falls within the range given by the equation of $14° \leqq \delta \leqq 20°$. The inclination angle within the above-mentioned range provides the greatest ratio of the heat transfer rate $\alpha$ to the pressure loss $\Delta P$, and, therefore, provides the greatest heat exchanging effect for a given driving power of the fan. The most preferred angle $\delta$ of inclination is 16° to 17° or therearound where the ratio $\alpha/\Delta P$ takes the peak value.

In the described embodiment, a tubular fin plate is used as the base material of the fin. This, however, is not exclusive, and a corrugated fin plate may be used instead of the described flat tabular one.

Figure 7:
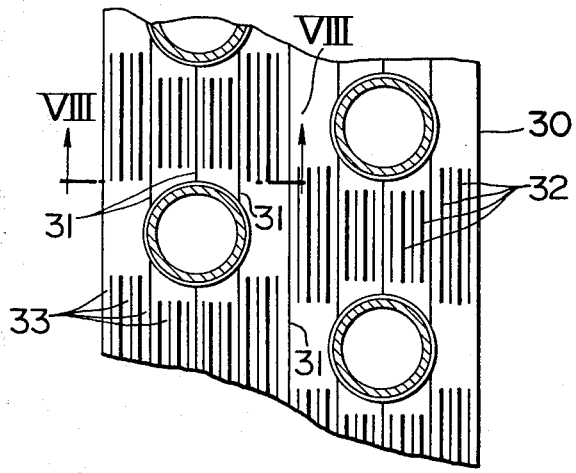
FIG. 7 is a plan view of another example of fin which is constructed by a corrugated fin plate provided with a number of upwardly convexed louver elements with an obtuse apex angle.
Figure 8:
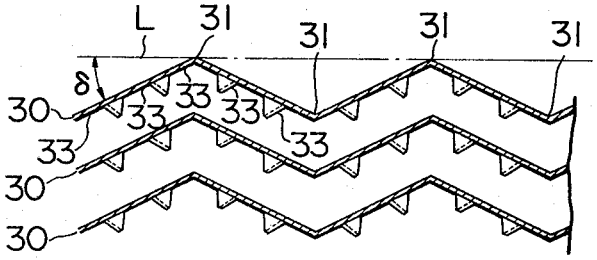
FIG. 8 is an enlarged sectional view taken along the line VIII—VIII of FIG. 7.

FIGS. 7 and 8 show another embodiment of the invention in which a corrugated fin plate is used as the base material of the fin of heat exchanger.

More specifically, a corrugated fin plate 30 is a plate-like member which is corrugated like an accordian so as to have crests and valleys at the edge lines denoted by reference numerals 31. As in the case of the first embodiment, a plurality of upwardly convexed louver elements 33 having obtuse apex angles are formed by bending a plurality of elongated sections defined by slits 32 formed in the fin plate 30. These louver elements are arranged in a manner of corrugation as a whole, such that the edges of the adjacent louver elements are staggered or offset in the direction of their heights. The angle $\delta$ of inclination of the flank of the louver element to the direction L in which the fin extends is same as that of the first embodiment. This second embodiment can provide a heat exchanging effect equivalent to that of the first embodiment. In addition, the stiffness or rigidity in the direction of array of tubes is further enhanced due to the use of the corrugated fin plate as the base member of the fin.

Figure 9:
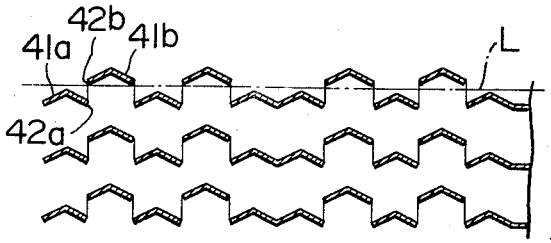
FIG. 9 is a sectional view of still another example of fin in which the louver elements with an obtuse apex angle are staggered in the heightwise direction.

FIG. 9 is a view similar to FIG. 4, and shows another example of the fin. In this example, the upwardly convexed louver elements 41a, 41b are disposed in the direction L in which the fin extends, such that these louver elements take alternately a high and low levels so that the edges 42a, 42b of adjacent louver elements are staggered in the direction of their heights. Other portions are all identical to that of the embodiment shown in FIG. 4. This fin has effects substantially equivalent to those brought about by the embodiment shown in FIG. 4.

In the embodiments heretofore described, the upwardly convexed louver elements are formed to have distinct edge lines with obtuse apex angles. This form of the upwardly convexed louver element, however, is not exclusive, and the upwardly convexed louver elements can have other forms.

Figure 10:
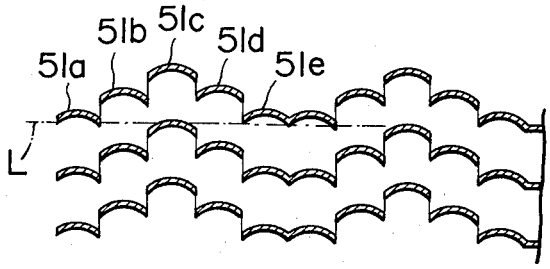
FIG. 10 is a sectional view of a further example of fin in which louver elements having arcuate cross-section are arranged in a manner of corrugation.

For instance, the louver element can have an arcuate cross-section. FIG. 10 is a view similar to FIG. 4; and shows an example of the fin having louver elements with arcuate cross-sections. In this fin, a plurality of louver elements 51*a*, 51*b*, 51*c*, 51*d* and 51*e* each having an arcuate cross-section are formed. These louver elements are disposed in the direction L in which the fin extends, in the form of corrugation as a whole, and the edges of adjacent louver elements are staggered in the direction of their heights, as in the previously described examples. Thus, the fin of this example has effects substantially equivalent to those of the previously described examples.

Figure 11:
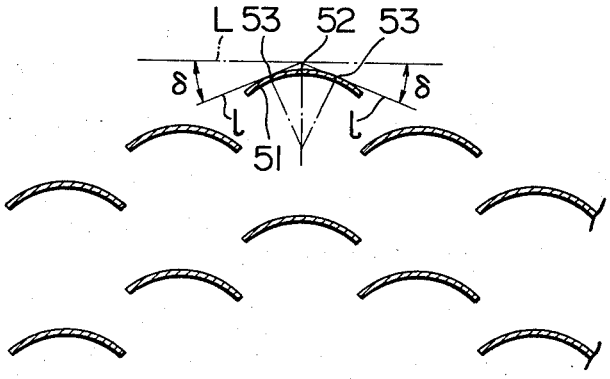
FIG. 11 is a sectional view of a still further example of fin in which the louver elements having an arcuate cross-section are staggered in the heightwise direction.

FIG. 11 illustrates the angle $\delta$ of inclination of the flank of a louver element when the latter has an arcuate cross-section. In this case, the inclination angle of the flank of the louver element is given as the inclination angle of the flank of a louver element with an obtuse apex angle having a cross-section which is closely approximate to the arcuate cross-section of the louver element in question. More specifically, when the arcuate cross-section of the lower element in question is equally divided into two sections by a straight line passing through the vertex 52, the angle formed between the direction L in which the fin extends and a line l tangential to the mid point 53 of each divided section is given as the inclination angle $\delta$. The inclination angle preferably falls within the range of $8° \leqq \delta \leqq 24°$ as in the case of previously described fins.

The broken line curves in FIG. 6 show how the ratio $\alpha/\Delta P$ of heat transfer rate $\alpha$ to the pressure loss $\Delta P$, the pressure loss $\Delta P$ and the second moment of area I are changed according to the change in the angle $\delta$ of inclination of the flank of the louver element having the arcuate cross-section, in the form of ratios to the values obtained when the inclination angle $\delta$ is 0°, i.e. when the louver element is flat. It will be seen that these broken line curves closely approximates the solid line curves which show the characteristics of the fin having upwardly convexed louver elements with obtuse apex angles. Therefore, also in case of upwardly convexed louver elements of arcuate cross-section, the inclination angle $\delta$ preferably falls within the range of between 8° and 24°, more preferably $14° \leqq \delta \leqq 20°$, and most preferably around 16° to 17°.

Figure 12:
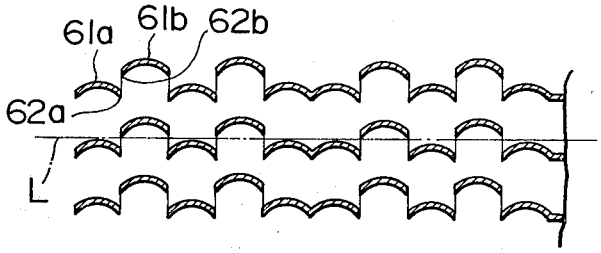
FIG. 12 is a sectional view of a still further example of the fin in which rows of the louver elements having an arcuate cross section are arranged in a high and a low level.

FIG. 12 is a cross-sectional view similar to FIG. 10, and shows another example of the fin having upwardly convexed louver elements of arcuate cross-section. In this example, the louver elements 61*a*, 61*b* . . . of arcuate cross-section are disposed in the direction L in which the fin extends, such that the successive louver elements take a high and low levels alternately so as to stagger the edges 62*a*, 62*b* . . . of the adjacent louver elements 61*a*, 61*b* . . . in the direction of their heights. Other portions are materially identical to those of the example shown in FIG. 10. The fin of this example has effects substantially equivalent to those of the example shown in FIG. 10.

The invention has been described with specific reference to the fins in which heat transfer tubes are arranged in two rows in a staggered or alternately offset manner. Needless to say, however, the invention can equally be applied to the heat exchangers in which a single row or three or more rows of the heat transfer tubes are arranged to pass through the fins.

Figure 13:
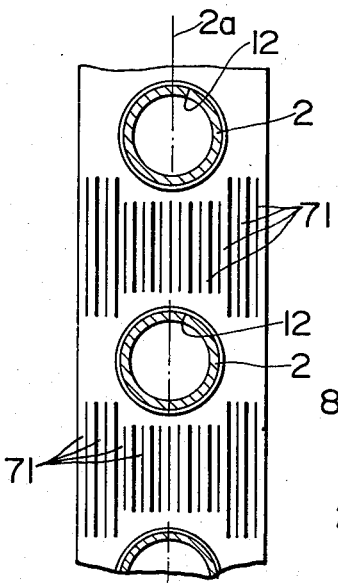
FIG. 13 is a plan view of a portion of a still further example of the fin including a single row of the heat transfer tube.

FIG. 13 shows an example of a fin in which heat transfer tubes are arrayed only in a single row. In this fin, a plurality of upwardly convexed louver elements 71 each having an obtuse apex angle or having arcuate cross-section are formed in the portions between respective pairs of adjacent tube-receiving bores 12 as in the case of previously described examples.

Figure 14:
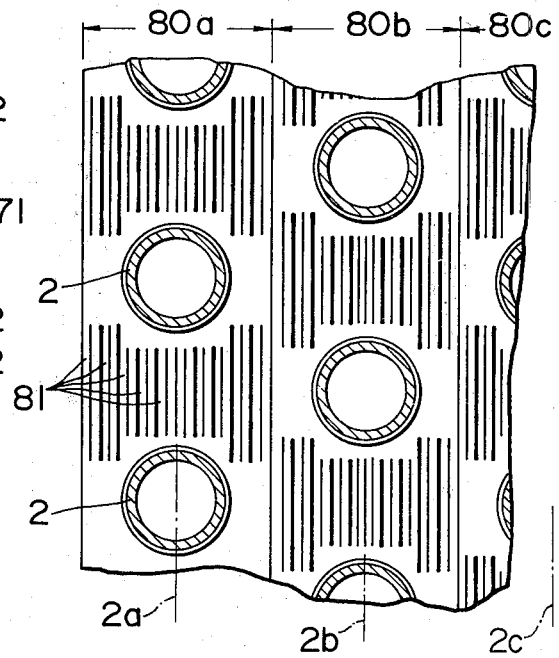
FIG. 14 is a plan view of a portion of a still further example of the fin including three rows of the heat transfer tubes.

FIG. 14 shows an example of a fin in which three or more rows 2*a*, 2*b*, 2*c* . . . of heat transfer tubes are arranged in a zigzag manner. In this case, unit fins 80*a*, 80*b*, 80*c* . . . are linked one to another in accordance with the number of rows of the heat transfer tubes. Upwardly convexed louver elements 81 each having an obtuse apex angle or arcuate cross-section are formed in the same manner as the examples which have been described heretofore.

What we claim is:

1. A cross-fin tube type heat exchanger comprising a large number of fins spaced in parallel with one another and each having a predetermined area, and a plurality of heat transfer tubes extended through and fixed to said fins, thereby to permit heat exchange, across the walls of said heat transfer tubes and through said fins, between a heat exchanging medium flowing through said heat transfer tubes and another heat exchanging medium flowing along the surfaces of said fins, said heat exchanger further comprising a large number of upwardly convexed louver elements formed in the portions of said fins between adjacent heat transfer tubes, said louver elements being formed by forming a number of slits in said portions of said fins in a direction perpendicular to that of flow of air flowing along the surfaces of said fins, bending each elongated section defined between respective adjacent slits to have an obtuse apex angle with the edge line extending on the breadthwise bisector line of the elongated section and raising said elongated sections in selected positions in the form of bridges such that the edges of adjacent obtuse type louver elements are staggered in the direction of their heights.

2. A heat exchanger as claimed in claim 1, wherein the successive upwardly convexed louver elements disposed in the direction in which said fin extends are staggered alternately in the direction of said louvers.

3. A heat exchanger as claimed in claim 1, wherein said heat transfer tubes are arranged in a single row.

4. A heat exchanger as claimed in claim 1, wherein each group of said upwardly convexed louver elements formed in each fin as a whole extends in a manner of corrugation in the direction in which said fin extends.

5. A heat exchanger as claimed in claim 4, wherein said upwardly convexed louver elements are formed on a corrugated fin plate.

6. A cross-fin tube type heat exchanger comprising a large number of fins spaced in parallel with one another and each having a predetermined area, and a plurality of heat transfer tubes extended through and fixed to said fins, thereby to permit heat exchange, across the walls of said heat transfer tubes and through said fins, between a heat exchanging medium flowing through said heat transfer tubes and another heat exchanging medium flowing along the surfaces of said fins, said heat exchanger further comprising a large number of upwardly convexed louver elements formed in the portions of said fins between adjacent heat transfer tubes, said louver elements being formed by forming a number of slits in said portions of said fins in a direction perpendicular to that of flow of air flowing along the surfaces of said fins, bending each elongated section defined between respective adjacent slits to have an arcuate cross-section with its apex extending on the breadthwise bisector line of the elongated section, and raising said elongated sections in selected positions in the form of bridges such that the edges of adjacent arcuate type louver elements are staggered in the direction of their heights.

7. A heat exchanger as claimed in claim 6, wherein the successive upwardly convexed louver elements disposed in the direction in which said fin extends are staggered alternately in the direction of said louvers.

8. A heat exchanger as claimed in claim 6, wherein said heat transfer tubes are arranged in a single row.

9. A heat exchanger as claimed in claim 6, wherein each group of said upwardly convexed louver elements formed in each fin as a whole extends in a manner of corrugation in the direction in which said fin extends.

10. A heat exchanger as claimed in claim 11, wherein said upwardly convexed louver elements are formed on a corrugated fin plate.

11. A cross-fin tube type heat exchanger comprising a large number of fins spaced in parallel with one another and each having a predetermined area, and a plurality of heat transfer tubes extended through and fixed to said fins, thereby to permit heat exchange, across the walls of said heat transfer tubes and through said fins, between a heat exchanging medium flowing through said heat transfer tubes and another heat exchanging medium flowing along the surfaces of said fins, said heat exchanger further comprising a large number of upwardly convexed louver elements formed in the portions of said fins between adjacent heat transfer tubes, said louver elements being formed by forming a number of slits in said portions of said fins in a direction perpendicular to that of flow of air flowing along the surfaces of said fins, bending each elongated section defined between respective adjacent slits to make said elongated section have an upwardly convexed cross-section and raising said elongated sections in selected positions in the form of bridges such that the edges of adjacent louver elements are staggered in the direction of their heights, and wherein each of said upwardly convexed louver elements is formed to have an obtuse apex angle diverging from the bisector line of said elongated section.

12. A heat exchanger as claimed in claim 11, wherein said heat transfer tubes are arranged in a single row.

13. A heat exchanger as claimed in claim 11, wherein said heat transfer tubes are arranged in more than two rows in a zigzag manner.

14. A heat exchanger as claimed in one of claims 11, 12, or 13 wherein the angle of inclination of each flank of said upwardly convexed louver elements to the direction in which said fin extends falls within the range of between 8° and 24°.

15. A heat exchanger as claimed in one of claims 11, 12, or 13 wherein the angle of inclination of each flank of said upwardly convexed louver elements to the direction in which said fin extends is preferably between 14° and 20°.

16. A heat exchanger as claimed in one of claims 11, 12, or 13 wherein the angle of inclination of each flank of said upwardly convexed louver elements to the direction in which said fin extends is preferably around 16° to 17°.

17. A cross-fin tube type heat exchanger comprising a large number of fins spaced in parallel with one another and each having a predetermined area, and a plurality of heat transfer tubes extended through and fixed to said fins, thereby to permit heat exchange, across the walls of said heat transfer tubes and through said fins, between a heat exchanging medium flowing through said heat transfer tubes and another heat exchanging medium flowing along the surfaces of said fins, said heat exchanger further comprising a large number of upwardly convexed louver elements formed in the portions of said fins between adjacent heat transfer tubes, said louver elements being formed by forming a number of slits in said portions of said fins in a direction perpendicular to that of flow of air flowing along the surfaces of said fins, bending each elongated section defined between respective adjacent slits to make said elongated section having an upwardly convexed cross-section and raising said elongated sections in selected positions in the form of bridges such that the edges of adjacent louver elements are staggered in the direction of their heights, wherein each of said upwardly convexed louver elements has an arcuate cross-section.

18. A heat exchanger as claimed in claim 17, wherein said heat transfer tubes are arranged in a single row.

19. A heat exchanger as claimed in claim 17, wherein said heat transfer tubes are arranged in more than two rows in a zigzag manner.

20. A heat exchanger as claimed in one of claims 17, 18, or 19 wherein when said arcuate cross section of said louver element is equally divided into two sections by a straight line passing through its vertex, the angle formed between the direction in which the fin extends and a line tangential to the mid point of each divided section falls within the range of between 8° and 24°.

21. A heat exchanger as claimed in one of claims 17, 18, or 19 wherein when said arcuate cross section of said louver element is equally divided into two sections by a straight line passing through its vertex, the angle formed between the direction in which the fin extends and a line tangential to the mid point of each divided section falls preferably within the range of between 14° and 20°.

22. A heat exchanger as claimed in one of claims 17, 18, or 19 wherein when said arcuate cross section of said louver element is equally divided into two sections by a straight line passing through its vertex, the angle formed between the direction in which the fin extends and a line tangential to the mid point of each divided section falls most preferably within the range of between 16° and 17°.

23. A heat exchanger as claimed in one of claims 11, 12, 13, 17, 18, or 19, wherein the successive upwardly convexed louver elements disposed in the direction in which said fin extends are staggered alternately in the direction of said louvers.

24. A heat exchanger as claimed in one of claims 11, 12, 13, 17, 18 or 19, wherein each group of said upwardly convexed louver elements formed in each fin as a whole extends in a manner of corrugation in the direction in which said fin extends.

25. A heat exchanger as claimed in claim 24, wherein said upwardly convexed louver elements are formed on a corrugated fin plate.

* * * * *